US010410645B2

(12) United States Patent
Choo et al.

(10) Patent No.: US 10,410,645 B2
(45) Date of Patent: Sep. 10, 2019

(54) METHOD AND APPARATUS FOR HIGH FREQUENCY DECODING FOR BANDWIDTH EXTENSION

(71) Applicant: SAMSUNG ELECTRONICS CO., LTD., Suwon-si (KR)

(72) Inventors: Ki-hyun Choo, Seoul (KR); Eun-mi Oh, Seoul (KR); Seon-ho Hwang, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/123,897

(22) PCT Filed: Mar. 3, 2015

(86) PCT No.: PCT/KR2015/002045
§ 371 (c)(1),
(2) Date: Sep. 6, 2016

(87) PCT Pub. No.: WO2015/133795
PCT Pub. Date: Sep. 11, 2015

(65) Prior Publication Data

US 2017/0092282 A1 Mar. 30, 2017

Related U.S. Application Data

(60) Provisional application No. 61/946,985, filed on Mar. 3, 2014.

(51) Int. Cl.
*G10L 19/12* (2013.01)
*G10L 21/038* (2013.01)
(Continued)

(52) U.S. Cl.
CPC ..... *G10L 19/12* (2013.01); *G10L 19/012* (2013.01); *G10L 19/167* (2013.01); *G10L 19/18* (2013.01); *G10L 21/038* (2013.01); *G10L 19/08* (2013.01)

(58) Field of Classification Search
USPC ..... 704/500–504
See application file for complete search history.

(56) References Cited

U.S. PATENT DOCUMENTS 5,455,888 A * 10/1995 Iyengar ..... G10L 21/038 704/203
7,630,881 B2 12/2009 Iser et al.
(Continued)

FOREIGN PATENT DOCUMENTS

CN 101089951 A 12/2007
CN 101197130 A 6/2008
(Continued)

OTHER PUBLICATIONS

International Search Report dated May 11, 2015 issued by International Searching Authority in counterpart International Application No. PCT/KR2015/002045 (PCT/ISA/210, PCT/ISA/220).
(Continued)

*Primary Examiner* — Leonard Saint Cyr
(74) *Attorney, Agent, or Firm* — Sughrue Mion, PLLC

(57) ABSTRACT

Disclosed are a method and an apparatus for high frequency decoding for bandwidth extension. The method for high frequency decoding for bandwidth extension comprises the steps of: decoding an excitation class; transforming a decoded low frequency spectrum on the basis of the excitation class; and generating a high frequency excitation spectrum on the basis of the transformed low frequency spectrum. The method and apparatus for high frequency decoding for bandwidth extension according to an embodiment can transform a restored low frequency spectrum and
(Continued)

generate a high frequency excitation spectrum, thereby improving the restored sound quality without an excessive increase in complexity.

10 Claims, 21 Drawing Sheets

(51) Int. Cl.

| | |
|---|---|
| ***G10L 19/18*** | (2013.01) |
| ***G10L 19/012*** | (2013.01) |
| ***G10L 19/16*** | (2013.01) |
| *G10L 19/08* | (2013.01) |

(56) References Cited

U.S. PATENT DOCUMENTS

| | | | | |
|---|---|---|---|---|
| 8,135,593 | B2 | 3/2012 | Miao et al. | |
| 8,417,515 | B2 | 4/2013 | Oshikiri et al. | |
| 8,688,440 | B2 | 4/2014 | Oshikiri | |
| 8,972,249 | B2 | 3/2015 | Suzuki et al. | |
| 9,111,532 | B2 | 8/2015 | Taleb et al. | |
| 9,589,568 | B2 | 3/2017 | Jeong et al. | |
| 2007/0067163 | A1* | 3/2007 | Kabal | G10L 21/038 704/207 |
| 2007/0282599 | A1* | 12/2007 | Choo | G10L 21/038 704/205 |
| 2008/0300866 | A1* | 12/2008 | Mukhtar | G10L 21/038 704/205 |
| 2009/0210234 | A1* | 8/2009 | Sung | G10L 19/18 704/500 |
| 2010/0063827 | A1* | 3/2010 | Gao | G10L 21/038 704/500 |
| 2011/0295598 | A1* | 12/2011 | Yang | G10L 21/038 704/205 |
| 2013/0226595 | A1* | 8/2013 | Liu | G10L 21/038 704/500 |
| 2013/0290003 | A1 | 10/2013 | Choo | |
| 2013/0317812 | A1 | 11/2013 | Jeong et al. | |
| 2014/0303967 | A1* | 10/2014 | Jeong | G10L 19/032 704/205 |
| 2016/0240207 | A1 | 8/2016 | Choo | |
| 2016/0247519 | A1 | 8/2016 | Choo | |

FOREIGN PATENT DOCUMENTS

| | | | |
|---|---|---|---|
| CN | 101751926 | A | 6/2010 |
| CN | 102280109 | A | 12/2011 |
| JP | 2010-20251 | A | 1/2010 |
| JP | 2010-538317 | A | 12/2010 |
| JP | 2011-215198 | A | 10/2011 |
| KR | 10-2006-0051298 | A | 5/2006 |
| KR | 10-2013-0007485 | A | 1/2013 |
| WO | 2005/111568 | A1 | 11/2005 |
| WO | 2012/108680 | A2 | 8/2012 |
| WO | 2012/108680 | A3 | 8/2012 |
| WO | 2013/141638 | A1 | 9/2013 |

OTHER PUBLICATIONS

Written Opinion dated May 11, 2015 issued by International Search Authority in counterpart International Application No. PCT/KR2015/002045 (PCT/ISA/237).

Communication dated Nov. 7, 2017, issued by the Japanese Patent Office in counterpart Japanese Application No. 2016-555511.

Communication dated Jun. 30, 2017 by the European Patent Office in counterpart European Patent Application No. 15759308.8.

"3GPP TS26.445 V12.0.0; 6.2 MDCT Coding mode decoding", 3rd Generation Partnership Project (3GPP), Dec. 10, 2014, pp. 520-606, XP05091305, retrieved from the Internet: URL:http://www.3gpp.org/ftp/Specs/archive/26_series/26.445/ [retrieved on Dec. 10, 2014].

Communication dated Mar. 20, 2019 issued by the State Intellectual Property Office of P.R. China in counterpart Chinese Application No. 201580022645.8.

* cited by examiner

METHOD AND APPARATUS FOR HIGH FREQUENCY DECODING FOR BANDWIDTH EXTENSION

TECHNICAL FIELD

One or more exemplary embodiments relate to audio encoding and decoding, and more particularly, to a method and apparatus for high frequency decoding for bandwidth extension (BWE).

BACKGROUND ART

The coding scheme in G.719 has been developed and standardized for videoconferencing. According to this scheme, a frequency domain transform is performed via a modified discrete cosine transform (MDCT) to directly code an MDCT spectrum for a stationary frame and to change a time domain aliasing order for a non-stationary frame so as to consider temporal characteristics. A spectrum obtained for a non-stationary frame may be constructed in a similar form to a stationary frame by performing interleaving to construct a codec with the same framework as the stationary frame. The energy of the constructed spectrum is obtained, normalized, and quantized. In general, the energy is represented as a root mean square (RMS) value, and bits required for each band is obtained from a normalized spectrum through energy-based bit allocation, and a bitstream is generated through quantization and lossless coding based on information about the bit allocation for each band.

According to the decoding scheme in G.719, in a reverse process of the coding scheme, a normalized dequantized spectrum is generated by dequantizing energy from a bitstream, generating bit allocation information based on the dequantized energy, and dequantizing a spectrum based on the bit allocation information. When the bits is insufficient, a dequantized spectrum may not exist in a specific band. To generate noise for the specific band, a noise filling method for generating a noise codebook based on a dequantized low frequency spectrum and generating noise according to a transmitted noise level is applied. For a band of a specific frequency or higher, a bandwidth extension scheme for generating a high frequency signal by folding a low frequency signal is applied.

DISCLOSURE

Technical Problems

One or more exemplary embodiments provide a method and an apparatus for high frequency decoding for bandwidth extension (BWE), by which the quality of a reconstructed audio signal may be improved, and a multimedia apparatus employing the same.

Technical Solution

According to one or more exemplary embodiments, a high frequency decoding method for bandwidth extension (BWE) includes decoding an excitation class, modifying a decoded low frequency spectrum based on the decoded excitation class, and generating a high frequency excitation spectrum, based on the modified low frequency spectrum.

According to one or more exemplary embodiments, a high frequency decoding apparatus for bandwidth extension (BWE) includes at least one processor configured to decode an excitation class, to modify a decoded low frequency spectrum based on the decoded excitation class, and to generate a high frequency excitation spectrum based on the modified low frequency spectrum.

Advantageous Effects

According to one or more exemplary embodiments, a reconstructed low frequency spectrum is modified to generate a high frequency excitation spectrum, thereby improving the quality of a reconstructed audio signal without excessive complexity.

DESCRIPTION OF DRAWINGS

These and/or other aspects will become apparent and more readily appreciated from the following description of the exemplary embodiments, taken in conjunction with the accompanying drawings in which.

MODE FOR INVENTION

Figure 1:
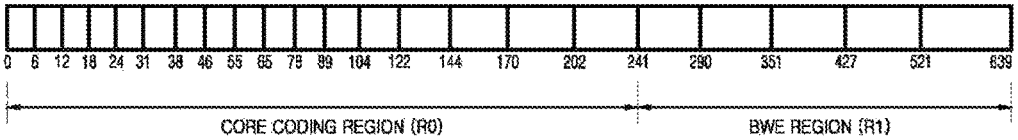
FIG. 1 illustrates sub-bands of a low frequency band and sub-bands of a high frequency band, according to an exemplary embodiment.

The present inventive concept may allow various changes or modifications in form, and specific exemplary embodiments will be illustrated in the drawings and described in detail in the specification. However, this is not intended to limit the present inventive concept to particular modes of practice, and it is to be appreciated that all changes, equivalents, and substitutes that do not depart from the technical spirit and technical scope of the present inventive concept are encompassed by the present inventive concept. In the specification, certain detailed explanations of the related art are omitted when it is deemed that they may unnecessarily obscure the essence of the present invention.

While the terms including an ordinal number, such as "first", "second", etc., may be used to describe various components, such components are not be limited by theses terms. The terms first and second should not be used to attach any order of importance but are used to distinguish one element from another element.

The terms used in the specification are merely used to describe particular embodiments, and are not intended to limit the scope of the present invention. Although general terms widely used in the present specification were selected for describing the present disclosure in consideration of the functions thereof, these general terms may vary according to intentions of one of ordinary skill in the art, case precedents, the advent of new technologies, or the like. Terms arbitrarily selected by the applicant of the present invention may also be used in a specific case. In this case, their meanings need to be given in the detailed description of the invention. Hence, the terms must be defined based on their meanings and the contents of the entire specification, not by simply stating the terms.

An expression used in the singular encompasses the expression in the plural, unless it has a clearly different meaning in the context. In the specification, it is to be understood that terms such as "including," "having," and "comprising" are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

One or more exemplary embodiments will now be described more fully hereinafter with reference to the accompanying drawings. In the drawings, like elements are denoted by like reference numerals, and repeated explanations thereof will not be given.

FIG. 1 illustrates sub-bands of a low frequency band and sub-bands of a high frequency band, according to an exemplary embodiment. According to an embodiment, a sampling rate is 32 KHz, and 640 modified discrete cosine transform (MDCT) spectral coefficients may be formed for 22 bands, more specifically, 17 bands of the low frequency band and 5 bands of the high frequency band. For example, a start frequency of the high frequency band is a 241st spectral coefficient, and 0th to 240th spectral coefficients may be defined as R0, that is, a region to be coded in a low frequency coding scheme, namely, a core coding scheme. In addition, 241st to 639th spectral coefficients may be defined as R1, that is, a high frequency band for which bandwidth extension (BWE) is performed. In the region R1, a band to be coded in a low frequency coding scheme according to bit allocation information may also exist.

Figure 2A:
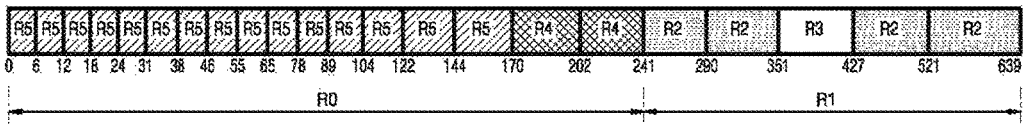
FIGS. 2A-2C illustrate division of a region R0 and a region R1 into R4 and R5, and R2 and R3, respectively, according to selected coding schemes, according to an exemplary embodiment.
Figure 2B:
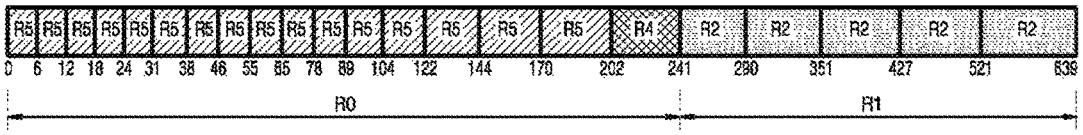
Figure 2C:
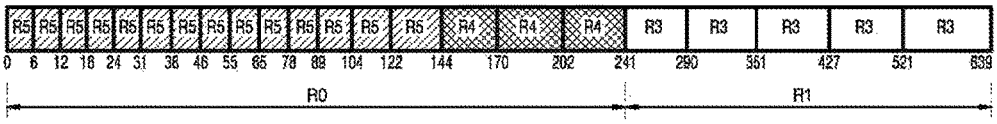

FIGS. 2A-2C illustrate division of the region R0 and the region R1 of FIG. 1 into R4 and R5, and R2 and R3, respectively, according to selected coding schemes. The region R1, which is a BWE region, may be divided into R2 and R3, and the region R0, which is a low frequency coding region, may be divided into R4 and R5. R2 indicates a band containing a signal to be quantized and lossless-coded in a low frequency coding scheme, e.g., a frequency domain coding scheme, and R3 indicates a band in which there are no signals to be coded in a low frequency coding scheme. However, even when it is determined that R2 is a band to which bits are allocated and which is coded in a low frequency coding scheme, when bits is insufficient, R2 may generate a band in the same way as R3. R5 indicates a band for which a low frequency coding scheme via allocated bits is performed, and R4 indicates a band for which coding cannot be performed even for a low frequency signal due to no extra bits or noise should be added due to less allocated bits. Thus, R4 and R5 may be identified by determining whether noise is added, wherein the determination may be performed by a percentage of the number of spectrums in a low-frequency-coded band, or may be performed based on in-band pulse allocation information when factorial pulse coding (FPC) is used. Since the bands R4 and R5 can be identified when noise is added thereto in a decoding process, the bands R4 and R5 may not be clearly identified in an encoding process. The bands R2 to R5 may have mutually different information to be encoded, and also, different decoding schemes may be applied to the bands R2 to R5.

In the illustration shown in FIG. 2A, two bands containing $170^{th}$ to $240^{th}$ spectral coefficients in the low frequency coding region R0 are R4 to which noise is added, and two bands containing $241^{st}$ to $350^{th}$ spectral coefficients and two bands containing $427^{th}$ to $639^{th}$ spectral coefficients in the BWE region R1 are R2 to be coded in a low frequency coding scheme. In the illustration shown in FIG. 2B, one band containing $202^{nd}$ to $240^{th}$ spectral coefficients in the low frequency coding region R0 is R4 to which noise is added, and all the five bands containing $241^{st}$ to $639^{th}$ spectral coefficients in the BWE region R1 are R2 to be coded in a low frequency coding scheme. In the illustration shown in FIG. 2C, three bands containing $144^{th}$ to $240^{th}$ spectral coefficients in the low frequency coding region R0 are R4 to which noise is added, and R2 does not exist in the BWE region R1. In general, R4 in the low frequency coding region R0 may be distributed in a high frequency band, and R2 in the BWE region R1 may not be limited to a specific frequency band.

Figure 3:
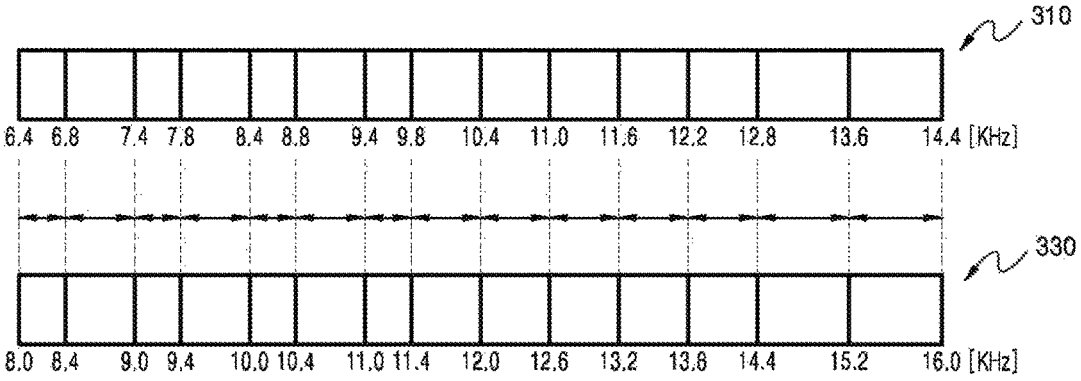
FIG. 3 illustrates sub-bands of a high frequency band, according to an exemplary embodiment.

FIG. 3 illustrates sub-bands of a high frequency band in a wideband (WB), according to an embodiment. A sampling rate is 32 KHz, and a high frequency band among 640 MDCT spectral coefficients may be formed by 14 bands. Four spectral coefficients may be included in a band of 100 Hz, and thus a first band of 400 Hz may include 16 spectral coefficients. Reference numeral 310 indicates a sub-band configuration of a high frequency band of 6.4 to 14.4 KHz, and reference numeral 330 indicates a sub-band configuration of a high frequency band of 8.0 to 16.0 KHz.

Figure 4:
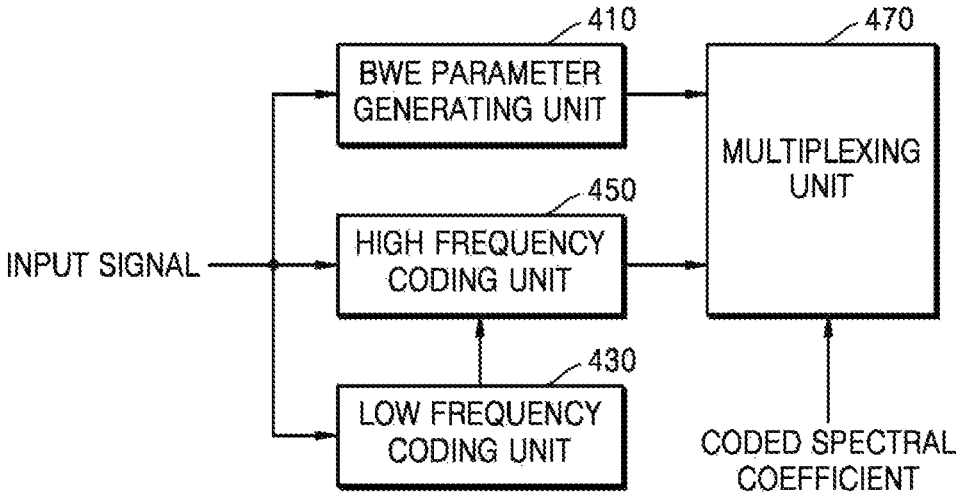
FIG. 4 is a block diagram of an audio encoding apparatus according to an exemplary embodiment.

FIG. 4 is a block diagram of an audio encoding apparatus according to an exemplary embodiment.

The audio encoding apparatus of FIG. 4 may include a BWE parameter generating unit 410, a low frequency coding unit 430, a high frequency coding unit 450, and a multiplexing unit 470. The components may be integrated into at least one module and implemented by at least one processor (not shown). An input signal may indicate music, speech, or a mixed signal of music and speech and may be largely divided into a speech signal and another general signal. Hereinafter, the input signal is referred to as an audio signal for convenience of description.

Referring to FIG. 4, the BWE parameter generating unit 410 may generate a BWE parameter for BWE. The BWE parameter may correspond to an excitation class. According to an implementation scheme, the BWE parameter may include an excitation class and other parameters. The BWE parameter generating unit 410 may generate an excitation class in units of frames, based on signal characteristics. In detail, the BWE parameter generating unit 410 may determine whether an input signal has speech characteristics or tonal characteristics, and may determine one among a plurality of excitation classes based on a result of the former determination. The plurality of excitation classes may include an excitation class related to speech, an excitation class related to tonal music, and an excitation class related to non-tonal music. The determined excitation class may be included in a bitstream and transmitted.

The low frequency coding unit 430 may encode a low band signal to generate an encoded spectral coefficient. The low frequency coding unit 430 may also encode information related to energy of the low band signal. According to an embodiment, the low frequency coding unit 430 may transform the low band signal into a frequency domain signal to generate a low frequency spectrum, and may quantize the low frequency spectrum to generate a quantized spectral coefficient. MDCT may be used for the domain transform, but embodiments are not limited thereto. Pyramid vector quantization (PVQ) may be used for the quantization, but embodiments are not limited thereto.

The high frequency coding unit 450 may encode a high band signal to generate a parameter necessary for BWE or bit allocation in a decoder end. The parameter necessary for BWE may include information related to energy of the high band signal and additional information. The energy may be represented as an envelope, a scale factor, average power, or norm of each band. The additional information is about a band including an important frequency component in a high band, and may be information related to a frequency component included in a specific high frequency band. The high frequency coding unit 450 may generate a high frequency spectrum by transforming the high band signal into a frequency domain signal, and may quantize information related to the energy of the high frequency spectrum. MDCT may be used for the domain transform, but embodiments are not limited thereto. Vector quantization may be used for the quantization, but embodiments are not limited thereto.

The multiplexing unit 470 may generate a bitstream including the BWE parameter (i.e., the excitation class), the parameter necessary for BWE or bit allocation, and the encoded spectral coefficient of a low band. The bitstream may be transmitted and stored.

A BWE scheme in the frequency domain may be applied by being combined with a time domain coding part. A code excited linear prediction (CELP) scheme may be mainly used for time domain coding, and time domain coding may be implemented so as to code a low frequency band in the CELP scheme and be combined with the BWE scheme in the time domain other than the BWE scheme in the frequency domain. In this case, a coding scheme may be selectively applied for the entire coding, based on adaptive coding scheme determination between time domain coding and frequency domain coding. To select an appropriate coding scheme, signal classification is required, and according to an embodiment, an excitation class may be determined for each frame by preferentially using a result of the signal classification.

Figure 5:
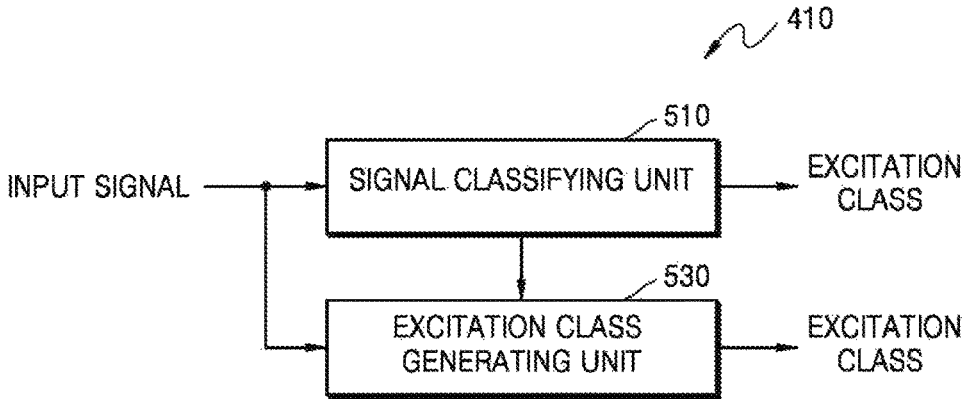
FIG. 5 is a block diagram of a bandwidth extension (BWE) parameter generating unit according to an exemplary embodiment.

FIG. 5 is a block diagram of the BWE parameter generating unit 410 of FIG. 4, according to an embodiment. The BWE parameter generating unit 410 may include a signal classifying unit 510 and an excitation class generating unit 530.

Referring to FIG. 5, the signal classifying unit 510 may classify whether a current frame is a speech signal by analyzing the characteristics of an input signal in units of frames, and may determine an excitation class according to a result of the classification. The signal classification may be performed using various well-known methods, e.g., by using short-term characteristics and/or long-term characteristics. The short-term characteristics and/or the long-term characteristics may be frequency domain characteristics and/or time domain characteristics. When a current frame is classified as a speech signal for which time domain coding is an appropriate coding scheme, a method of allocating a fixed-type excitation class may be more helpful for the improvement of sound quality than a method based on the characteristics of a high frequency signal. The signal classification may be performed on the current frame without taking into account a result of a classification with respect to a previous frame. In other words, even when the current frame by taking into account a hangover may be finally classified as a case that frequency domain coding is appropriate, a fixed excitation class may be allocated when the current frame itself is classified as a case that time domain coding is appropriate. For example, when the current frame is classified as a speech signal for which time domain coding is appropriate, the excitation class may be set to be a first excitation class related to speech characteristics.

When the current frame is not classified as a speech signal as a result of the classification of the signal classifying unit 510, the excitation class generating unit 530 may determine an excitation class by using at least one threshold. According to an embodiment, when the current frame is not classified as a speech signal as a result of the classification of the signal classifying unit 510, the excitation class generating unit 530 may determine an excitation class by calculating a tonality value of a high band and comparing the calculated tonality value with the threshold. A plurality of thresholds may be used according to the number of excitation classes. When a single threshold is used and the calculated tonality value is greater than the threshold, the current frame may be classified as a tonal music signal. On the other hand, when a single threshold is used and the calculated tonality value is smaller than the threshold, the current frame may be classified to a non-tonal music signal, for example, a noise signal. When the current frame is classified as a tonal music signal, the excitation class may be determined as a second excitation class related to tonal characteristics. On the other hand, when the current frame is classified as a noise signal, the excitation class may be determined as a third excitation class related to non-tonal characteristics.

Figure 6:
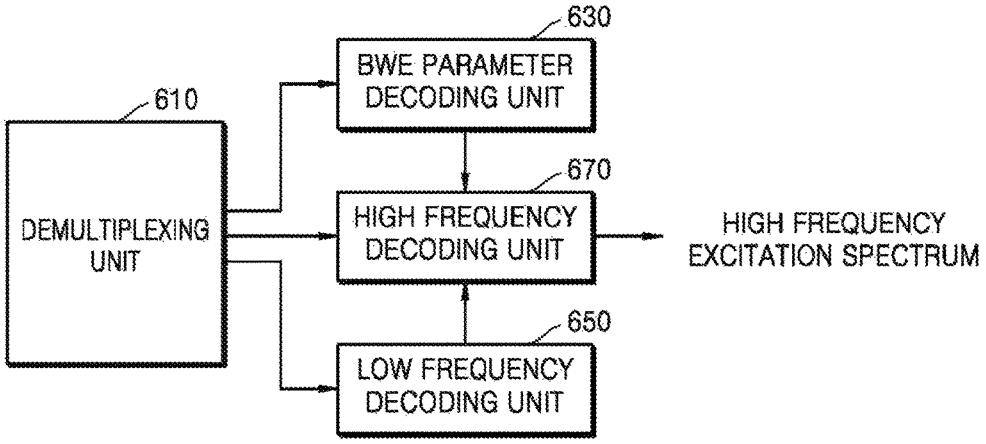
FIG. 6 is a block diagram of an audio decoding apparatus according to an exemplary embodiment.

FIG. 6 is a block diagram of an audio decoding apparatus according to an exemplary embodiment.

The audio decoding apparatus of FIG. 6 may include a demultiplexing unit 610, a BWE parameter decoding unit 630, a low frequency decoding unit 650, and a high frequency decoding unit 670. Although not shown in FIG. 6, the audio decoding apparatus may further include a spectrum combining unit and an inverse transform unit. The components may be integrated into at least one module and implemented by at least one processor (not shown). An input signal may indicate music, speech, or a mixed signal of music and speech and may be largely divided into a speech signal and another general signal. Hereinafter, the input signal is referred to as an audio signal for convenience of description.

Referring to FIG. 6, the demultiplexing unit 610 may parse a received bitstream to generate a parameter necessary for decoding.

The BWE parameter decoding unit 630 may decode a BWE parameter included in the bistream. The BWE parameter may correspond to an excitation class. The BWE parameter may include an excitation class and other parameters.

The low frequency decoding unit 650 may generate a low frequency spectrum by decoding an encoded spectral coefficient of a low band included in the bitstream. The low frequency decoding unit 650 may also decode information related to energy of a low band signal.

The high frequency decoding unit 670 may generate a high frequency excitation spectrum by using the decoded low frequency spectrum and an excitation class. According to another embodiment, the high frequency decoding unit 670 may decode a parameter necessary for BWE or bit allocation included in the bistream and may apply the parameter necessary for BWE or bit allocation and the decoded information related to the energy of the low band signal to the high frequency excitation spectrum.

The parameter necessary for BWE may include information related to the energy of a high band signal and additional information. The additional information is regarding a band including an important frequency component in a high band, and may be information related to a frequency component included in a specific high frequency band. The information related to the energy of the high band signal may be vector-dequantized.

The spectrum combining unit (not shown) may combine the spectrum provided from the low frequency decoding unit 650 with the spectrum provided from the high frequency decoding unit 670. The inverse transform unit (not shown) may inversely transform a combined spectrum resulting from the spectrum combination into a time domain signal. Inverse MDCT (IMDCT) may be used for the domain inverse-transform, but embodiments are not limited thereto.

Figure 7:
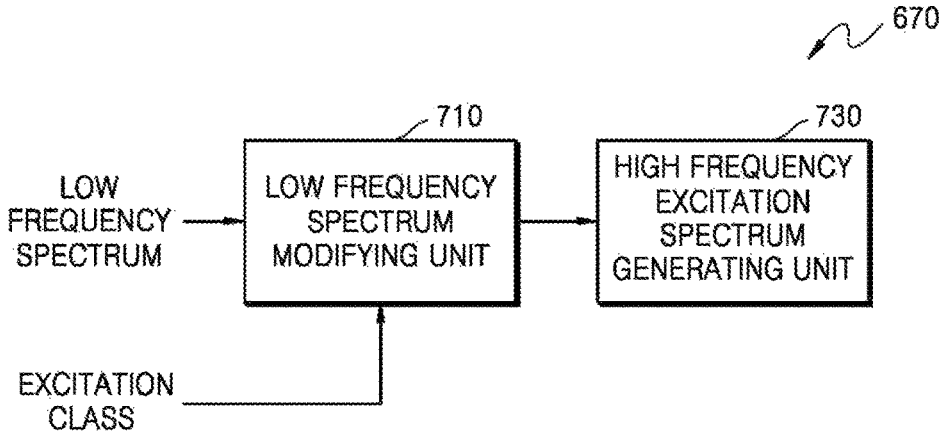
FIG. 7 is a block diagram of a high frequency decoding apparatus according to an exemplary embodiment.

FIG. 7 is a block diagram of a high frequency decoding apparatus according to an exemplary embodiment. The high frequency decoding apparatus of FIG. 7 may correspond to the high frequency decoding unit 670 of FIG. 6 or may be implemented as a special apparatus. The high frequency decoding apparatus of FIG. 7 may include a low frequency spectrum modifying unit 710 and a high frequency excitation spectrum generating unit 730. Although not shown in FIG. 7, the high frequency decoding apparatus may further include a receiving unit that receives a decoded low frequency spectrum.

Referring to FIG. 7, the low frequency spectrum modifying unit 710 may modify the decoded low frequency spectrum, based on an excitation class. According to an embodiment, the decoded low frequency spectrum may be a noise filled spectrum. According to another embodiment, the decoded low frequency spectrum may be a spectrum obtained by performing noise filling and then performing an anti-sparseness process of inserting again a random sign and a coefficient having an amplitude of a certain value into a spectrum portion remaining as zero.

The high frequency excitation spectrum generating unit 730 may generate a high frequency excitation spectrum from the modified low frequency spectrum. In addition, the high frequency excitation spectrum generating unit 730 may apply a gain to the energy of the generated high frequency excitation spectrum such that the energy of the high frequency excitation spectrum matches with a dequantized energy.

Figure 8:
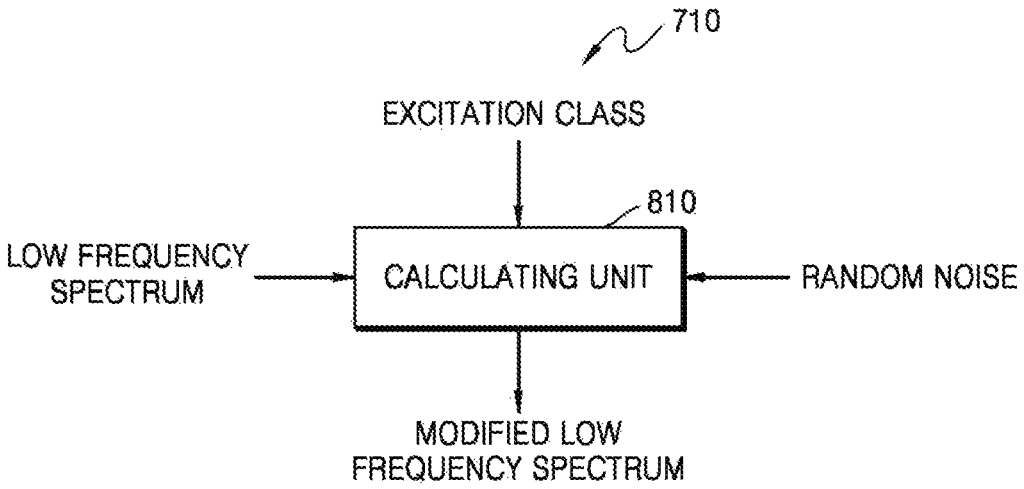
FIG. 8 is a block diagram of a low frequency spectrum modifying unit according to an exemplary embodiment.

FIG. 8 is a block diagram of the low frequency spectrum modifying unit 710 of FIG. 7, according to an embodiment. The low frequency spectrum modifying unit 710 of FIG. 8 may include a calculating unit 810.

Referring to FIG. 8, the calculating unit 810 may generate the modified low frequency spectrum by performing a predetermined computation with respect to the decoded low frequency spectrum based on the excitation class. The decoded low frequency spectrum may correspond to a noise filled spectrum, an anti-sparseness-processed spectrum, or a dequantized low frequency spectrum to which no noise is added. The predetermined computation may mean a process of determining a weight according to the excitation class and mixing the decoded low frequency spectrum with a random noise based on the determined weight. The predetermined computation may include a multiplication process and an addition process. The random noise may be generated in various well-known methods, for example, using a random seed. The calculating unit 810 may further include a process of matching a whitened low frequency spectrum with the random noise so that the levels thereof are similar to each other, before the predetermined computation.

Figure 9:
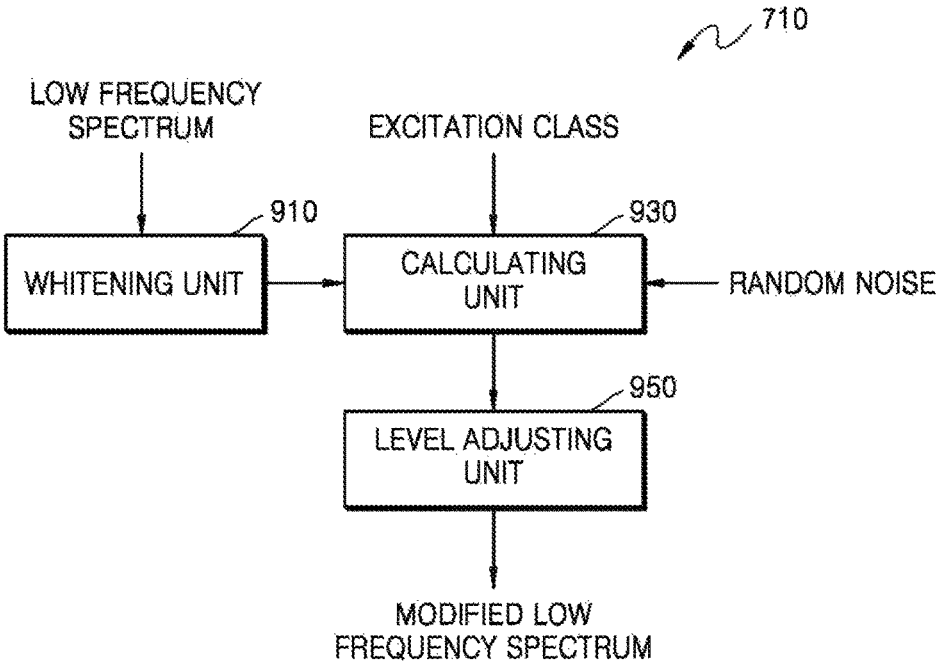
FIG. 9 is a block diagram of a low frequency spectrum modifying unit according to another exemplary embodiment.

FIG. 9 is a block diagram of the low frequency spectrum modifying unit 710 of FIG. 7, according to another embodiment. The low frequency spectrum modifying unit 710 of FIG. 9 may include a whitening unit 910, a calculating unit 930, and a level adjusting unit 950. The level adjusting unit 950 may be optionally included.

Referring to FIG. 9, the whitening unit 910 may perform whitening on the decoded low frequency spectrum. Noise may be added to a portion remaining as zero in the decoded low frequency spectrum, via noise filling or an anti-sparseness process. The noise addition may be selectively performed in units of sub-bands. Whitening is normalization based on envelope information of a low frequency spectrum, and may be performed using various well-known methods. In detail, the normalization may correspond to calculating an envelope from the low frequency spectrum and dividing the low frequency spectrum by the envelope. In whitening, a spectrum has a flat shape, and a fine structure of an internal frequency may be maintained. A window size for normalization may be determined according to signal characteristics.

The calculating unit 930 may generate the modified low frequency spectrum by performing a predetermined computation with respect to a whitened low frequency spectrum based on the excitation class. The predetermined computation may mean a process of determining a weight according to the excitation class and mixing the whitened low frequency spectrum with random noise based on the determined weight. The calculating unit 930 may operate the same as the calculating unit 810 of FIG. 8.

Figure 10:
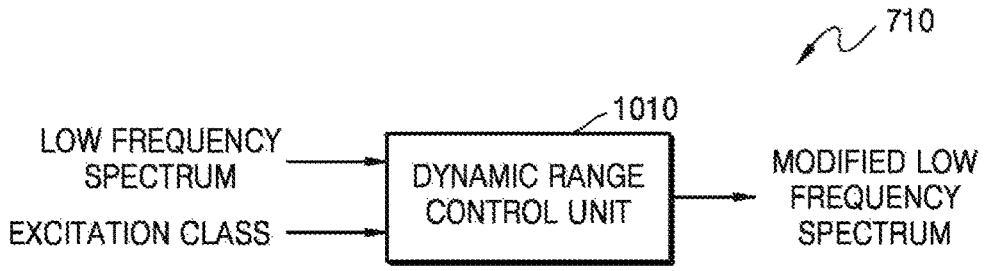
FIG. 10 is a block diagram of a low frequency spectrum modifying unit according to another exemplary embodiment.

FIG. 10 is a block diagram of the low frequency spectrum modifying unit 710 of FIG. 7, according to another embodiment. The low frequency spectrum modifying unit 710 of FIG. 10 may include a dynamic range control unit 1010.

Referring to FIG. 10, the dynamic range control unit 1010 may generate the modified low frequency spectrum by controlling a dynamic range of the decoded low frequency spectrum based on the excitation class. The dynamic range may mean a spectrum amplitude.

Figure 11:
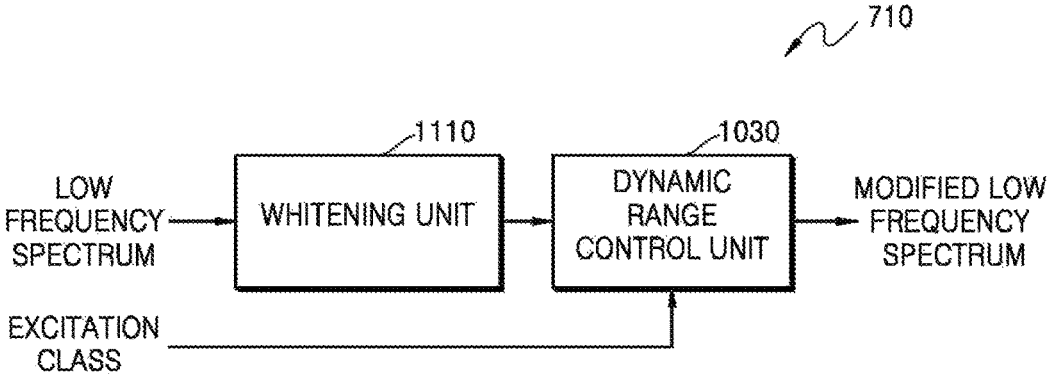
FIG. 11 is a block diagram of a low frequency spectrum modifying unit according to another exemplary embodiment.

FIG. 11 is a block diagram of the low frequency spectrum modifying unit 710 of FIG. 7, according to another embodiment. The low frequency spectrum modifying unit 710 of FIG. 11 may include a whitening unit 1110 and a dynamic range control unit 1130.

Referring to FIG. 11, the whitening unit 1110 may operate the same as the whitening unit 910 of FIG. 9. In other words, the whitening unit 1110 may perform whitening on the decoded low frequency spectrum. Noise may be added to a portion remaining as zero in the restored low frequency spectrum, via noise filling or an anti-sparseness process. The noise addition may be selectively performed in units of sub-bands. Whitening is normalization based on envelope information of a low frequency spectrum, and may apply various well-known methods. In detail, the normalization may correspond to calculating an envelope from the low frequency spectrum and dividing the low frequency spectrum by the envelope. In whitening, a spectrum has a flat shape, and a fine structure of an internal frequency may be maintained. A window size for normalization may be determined according to signal characteristics.

The dynamic range control unit 1130 may generate the modified low frequency spectrum by controlling a dynamic range of the whitened low frequency spectrum based on the excitation class.

Figure 12:
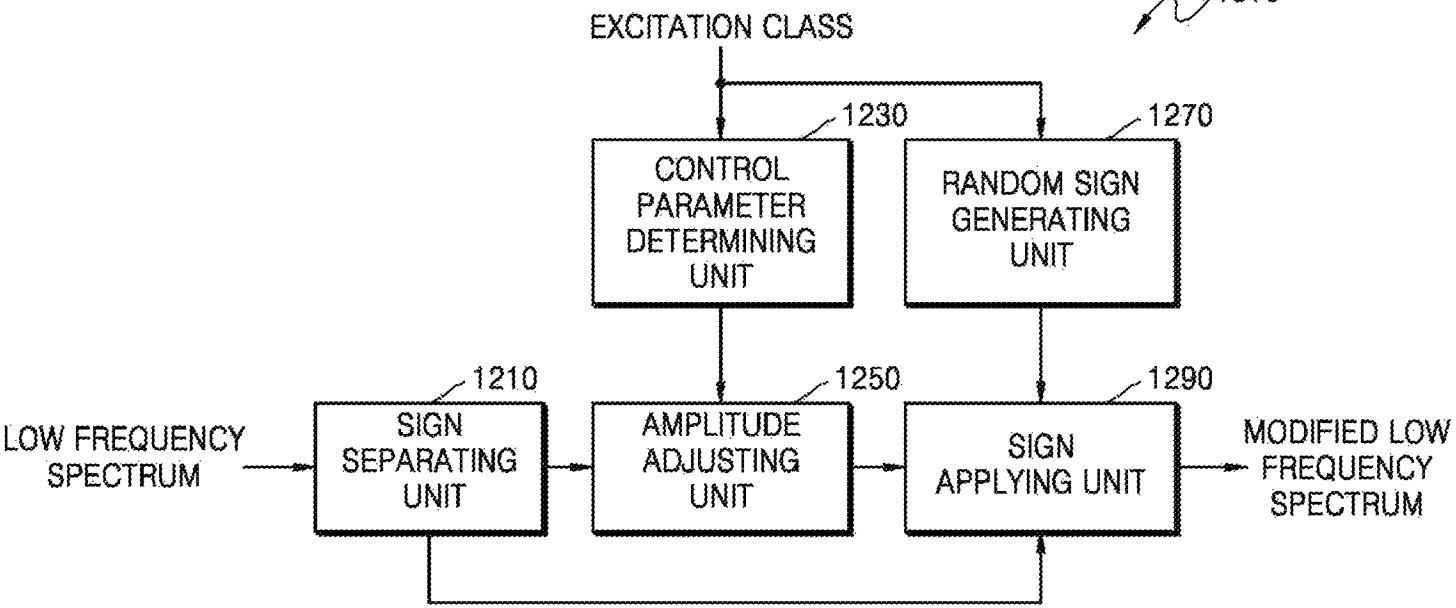
FIG. 12 is a block diagram of a dynamic range control unit according to an exemplary embodiment.

FIG. 12 is a block diagram of the dynamic range control unit 1110 of FIG. 11, according to an embodiment. The dynamic range control unit 1130 may include a sign separating unit 1210, a control parameter determining unit 1230, an amplitude adjusting unit 1250, a random sign generating unit 1270, and a sign applying unit 1290. The random sign generating unit 1270 may be integrated with the sign applying unit 1290.

Referring to FIG. 12, the sign separating unit 1210 may generate an amplitude, namely, an absolute spectrum, by removing a sign from the decoded low frequency spectrum.

The control parameter determining unit 1230 may determine a control parameter, based on the excitation class. Since the excitation class is information related to tonal characteristics or flat characteristics, the control parameter determining unit 1230 may determine a control parameter capable of controlling the amplitude of the absolute spectrum, based on the excitation class. The amplitude of the absolute spectrum may be represented as a dynamic range or a peak-valley interval. According to an embodiment, the control parameter determining unit 1230 may determine different values of control parameters according to different excitation classes. For example, when the excitation class is related to speech characteristics, the value 0.2 may be allocated as the control parameter. When the excitation class is related to tonal characteristics, the value 0.05 may be allocated as the control parameter. When the excitation class is related to noise characteristics, the value 0.8 may be allocated as the control parameter. Accordingly, in the case of frames having noise characteristics in a high frequency band, a degree of controlling the amplitude may be large.

The amplitude adjusting control unit 1250 may adjust the amplitude, namely, the dynamic range, of the low frequency spectrum, based on the control parameter determined by the control parameter determining unit 1230. In this case, the larger the value of the control parameter is, the more the dynamic range is controlled. According to an embodiment, the dynamic range may be controlled by adding or subtracting a predetermined size of amplitude to the original absolute spectrum. The predetermined size of amplitude may correspond to a value obtained by multiplying a difference between the amplitude of each frequency bin of a specific band of the absolute spectrum and an average amplitude of the specific band by the control parameter. The amplitude adjusting unit 1250 may construct the low frequency spectrum with bands having the same sizes and may process the constructed low frequency spectrum. According to an embodiment, each band may be constructed to include 16 spectral coefficients. An average amplitude may be calculated for each band, and the amplitude of each frequency bin included in each band may be controlled based on the average amplitude of each band and the control parameter. For example, a frequency bin having a greater amplitude than the average amplitude of a band decreases the amplitude thereof, and a frequency bin having a smaller amplitude than the average amplitude of a band increases the amplitude thereof. The degree of controlling the dynamic range may vary depending on the type of excitation class. In detail, the dynamic range control may be performed according to Equation 1:

$$S'[i]=S[i]-(S[i]-m[k])*a \quad \text{[Equation 1]}$$

where S'[i] indicates an amplitude of a frequency bin i whose a dynamic range is controlled, S[i] indicates an amplitude of the frequency bin i, m[k] indicates an average amplitude of a band to which the frequency bin i belongs, and a indicates a control parameter. According to an embodiment, each amplitude may be an absolute value. Accordingly, the dynamic range control may be performed in units of spectral coefficients, namely, frequency bins, of a band. The average amplitude may be calculated in units of bands, and the control parameter may be applied in units of frames.

Each band may be constructed based on a start frequency on which transposition is to be performed. For example, each band may be constructed to include 16 frequency bins starting from a transposition frequency bin 2. In detail, in the case of a super wideband (SWB), 9 bands ending at a frequency bin 145 at 24.4 kbps may exist, and 8 bands ending at a frequency bin 129 at 32 kbps may exist. In the case of a full band (FB), 19 bands ending at a frequency bin 305 at 24.4 kbps may exist, and 18 bands ending at a frequency bin 289 at 32 kbps may exist.

When it is determined based on the excitation class that a random sign is necessary, the random sign generating unit 1270 may generate the random sign. The random sign may be generated in units of frames. According to an embodiment, in the case of excitation classes related to noise characteristics, the random sign may be applied.

The sign applying unit 1290 may generate the modified low frequency spectrum by applying the random sign or the original sign to a low frequency spectrum of which a dynamic range has been controlled. The original sign may be the sign removed by the sign separating unit 1210. According to an embodiment, in the case of excitation classes related to noise characteristics, the random sign may be applied. In the case of excitation classes related to tonal characteristics or speech characteristics, the original sign may be applied. In detail, in the case of frames determined to be noisy, the random sign may be applied. In the case of frames determined to be tonal or to be a speech signal, the original sign may be applied.

Figure 13:
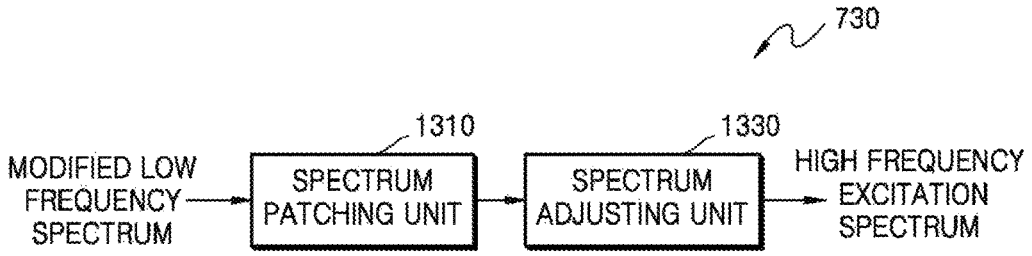
FIG. 13 is a block diagram of a high frequency excitation spectrum generating unit according to an exemplary embodiment.

FIG. 13 is a block diagram of the high frequency excitation spectrum generating unit 730 of FIG. 7, according to an embodiment. The high frequency excitation spectrum generating unit 730 of FIG. 13 may include a spectrum patching unit 1310 and a spectrum adjusting unit 1330. The spectrum adjusting unit 1330 may be optionally included.

Referring to FIG. 13, the spectrum patching unit 1310 may fill an empty high band with a spectrum by patching, for example, transposing, copying, mirroring, or folding, the modified low frequency spectrum to a high band. According to an embodiment, a modified spectrum existing in a source band of 50 to 3,250 Hz may be copied to a band of 8,000 to 11,200 Hz, a modified spectrum existing in the source band of 50 to 3,250 Hz may be copied to a band of 11,200 Hz to 14,400 Hz, and a modified spectrum existing in a source band of 2,000 to 3,600 Hz may be copied to a band of 14,400 to 16,000 Hz. Through this process, the high frequency excitation spectrum may be generated from the modified low frequency spectrum.

The spectrum adjusting unit 1330 may adjust the high frequency excitation spectrum that is provided from the spectrum patching unit 1310, in order to address discontinuity of a spectrum at the boundary between bands patched by the spectrum patching unit 1310. According to an embodiment, the spectrum adjusting unit 1330 may utilize spectrums around the boundary of the high frequency excitation spectrum that is provided by the spectrum patching unit 1310.

The high frequency excitation spectrum generated as described above or the adjusted high frequency excitation spectrum may be combined with the decoded low frequency spectrum, and a combined spectrum resulting from the combination may be generated as a time domain signal via inverse transform. The high frequency excitation spectrum and the decoded low frequency spectrum may be individually inversely transformed and then combined. IMDCT may be used for the inverse transform, but embodiments are not limited thereto.

An overlapping portion of a frequency band during the spectrum combination may be reconstructed via an overlap-add process. Alternatively, an overlapping portion of a frequency band during the spectrum combination may be reconstructed based on information transmitted via the bitstream. Alternatively, either an overlap-add process or a process based on the transmitted information may be applied according to environments of a receiving side, or the overlapping portion of a frequency band may be reconstructed based on a weight.

Figure 14:
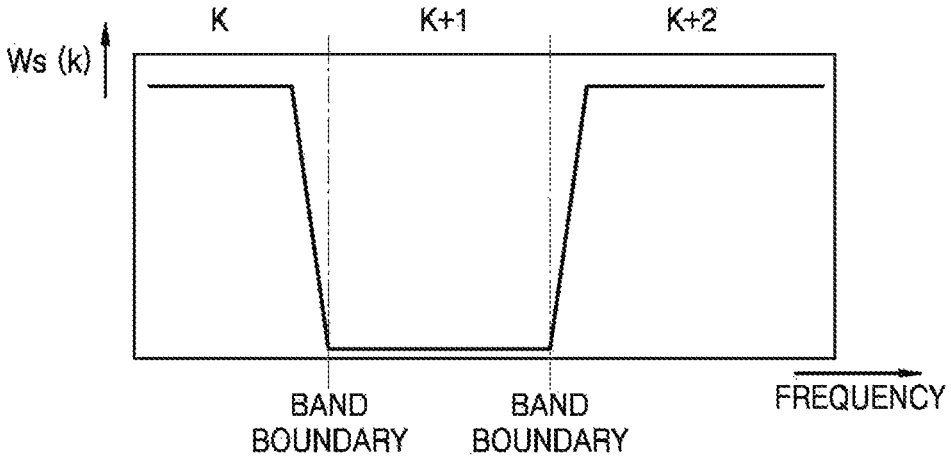
FIG. 14 is a graph for describing smoothing of a weight at a band boundary.

FIG. 14 is a graph for describing smoothing a weight at a band boundary. Referring to FIG. 14, since a weight of a (K+2)th band and a weight of a (K+1)th band are different from each other, smoothing is necessary at a band boundary. In the example of FIG. 14, smoothing is not performed for the (K+1)th band and is only performed for the (K+2)th band, because a weight Ws(K+1) of the (K+1)th band is 0, and when smoothing is performed for the (K+1)th band, the weight Ws(K+1) of the (K+1)th band is not zero, and in this case, random noise in the(K+1)th band also should be considered. In other words, a weight of 0 indicates that random noise is not considered in a corresponding band when a high frequency excitation spectrum is generated. The weight of 0 corresponds to an extreme tonal signal, and random noise is not considered to prevent a noisy sound from being generated by noise inserted into a valley duration of a harmonic signal due to the random noise.

When a scheme, e.g., a vector quantization (VQ) scheme, other than a low frequency energy transmission scheme is applied to high frequency energy, the low frequency energy may be transmitted using lossless coding after scalar quantization, and the high frequency energy may be transmitted after quantization in another scheme. In this case, the last band in the low frequency coding region R0 and the first band in the BWE region R1 may overlap each other. In addition, the bands in the BWE region R1 may be configured in another scheme to have a relatively dense structure for band allocation.

For example, the last band in the low frequency coding region R0 may end at 8.2 KHz and the first band in the BWE region R1 may begin from 8 KHz. In this case, an overlap region exists between the low frequency coding region R0 and the BWE region R1. As a result, two decoded spectra may be generated in the overlap region. One is a spectrum generated by applying a low frequency decoding scheme, and the other one is a spectrum generated by applying a high frequency decoding scheme. An overlap and add scheme may be applied so that transition between the two spectra, i.e., a low frequency spectrum and a high frequency spectrum, is more smoothed. For example, the overlap region may be reconfigured by simultaneously using the two spectra, wherein a contribution of a spectrum generated in a low frequency scheme is increased for a spectrum close to the low frequency in the overlap region, and a contribution of a spectrum generated in a high frequency scheme is increased for a spectrum close to the high frequency in the overlap region.

For example, when the last band in the low frequency coding region R0 ends at 8.2 KHz and the first band in the BWE region R1 begins from 8 KHz, if 640 sampled spectra are constructed at a sampling rate of 32 KHz, eight spectra, i.e., 320th to 327th spectra, overlap, and the eight spectra may be generated using Equation 2:

$$\hat{S}(k)=\hat{S}_l(k)*w_0(k-L0)+(1-w_0(k-L0))*\hat{S}_h(k), L0\le k\le L1 \quad \text{[Equation 2]}$$

where $\hat{s}_l$ (k) denotes a spectrum decoded in a low frequency scheme, $\hat{s}_h$ (k) denotes a spectrum decoded in a high frequency scheme, L0 denotes a position of a start spectrum of a high frequency, L0~L1 denotes an overlap region, and w0 denotes a contribution.

Figure 15:
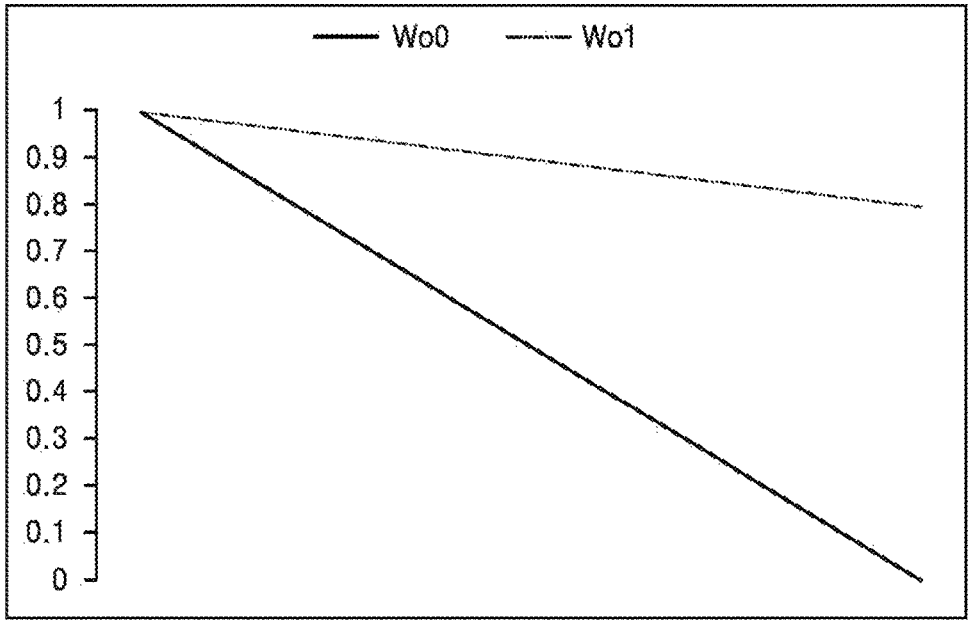
FIG. 15 is a graph for describing a weight as a contribution to be used to generate a spectrum in an overlap region, according to an exemplary embodiment.

FIG. 15 is a graph for describing a contribution to be used to generate a spectrum existing in an overlap region after BWE processing at the decoding end, according to an embodiment.

Referring to FIG. 15, $w_{o0}(k)$ and $w_{o1}(k)$ may be selectively applied to $w_o(k)$, wherein $w_{o0}(k)$ indicates that the same weight is applied to low frequency and high frequency decoding schemes, and $w_{o1}(k)$ indicates that a greater weight is applied to the high frequency decoding scheme. An example among various selection criteria for $w_o(k)$ is whether pulses exist in an overlapping band of a low frequency. When pulses in the overlapping band of the low frequency have been selected and coded, $w_{o0}(k)$ is used to make a contribution for a spectrum generated at the low frequency valid up to the vicinity of L1 and to decrease a contribution of a high frequency. Basically, a spectrum generated in an actual coding scheme may have higher proximity to an original signal than a spectrum of a signal generated by BWE. By using this, in an overlapping band, a scheme for increasing a contribution of a spectrum closer to the original signal may be applied, and accordingly, a smoothing effect and improvement of sound quality may be expected.

Figure 16:
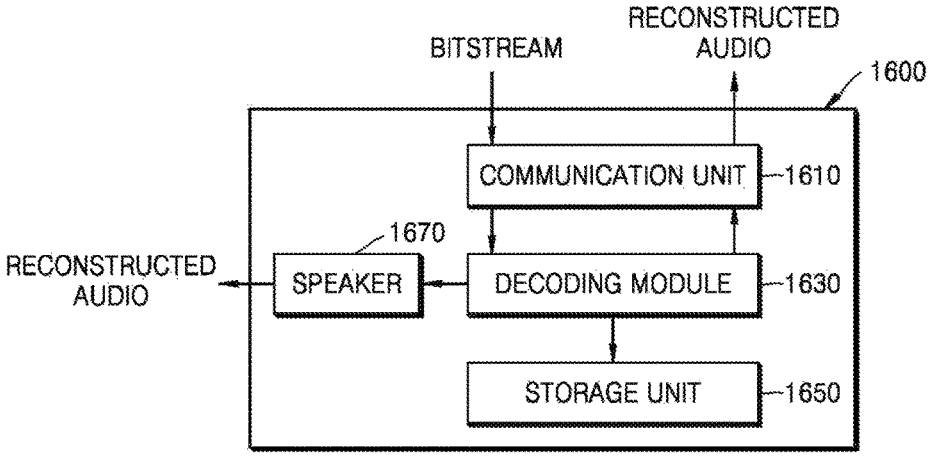
FIG. 16 is a block diagram of a multimedia apparatus including a decoding module, according to an exemplary embodiment.

FIG. 16 is a block diagram illustrating a configuration of a multimedia device including a decoding module, according to an exemplary embodiment.

A multimedia device 1600 shown in FIG. 16 may include a communication unit 1610 and a decoding module 1630. In addition, a storage unit 1650 for storing an audio bitstream obtained as an encoding result may be further included according to the usage of the audio bitstream. In addition, the multimedia device 1600 may further include a speaker 1670. That is, the storage unit 1650 and the speaker 1670 may be optionally provided. The multimedia device 1600 shown in FIG. 16 may further include an arbitrary encoding module (not shown), for example, an encoding module for performing a generic encoding function or an encoding module according to an exemplary embodiment. Herein, the decoding module 1630 may be integrated with other components (not shown) provided to the multimedia device 1600 and be implemented as at least one processor (not shown).

Referring to FIG. 16, the communication unit 1610 may receive at least one of audio and an encoded bitstream provided from the outside or transmit at least one of reconstructed audio signal obtained as a decoding result of the decoding module 1630 and an audio bitstream obtained as an encoding result. The communication unit 1610 is configured to enable transmission and reception of data to and from an external multimedia device or server through a wireless network such as wireless Internet, a wireless intranet, a wireless telephone network, a wireless local area network (LAN), a Wi-Fi network, a Wi-Fi Direct (WFD) network, a third generation (3G) network, a 4G network, a Bluetooth network, an infrared data association (IrDA) network, a radio frequency identification (RFID) network, an ultra wideband (UWB) network, a ZigBee network, and a near field communication (NFC) network or a wired network such as a wired telephone network or wired Internet.

The decoding module 1630 may receive a bitstream provided through the communication unit 1610 and decode an audio spectrum included in the bitstream. The decoding may be performed using the above-described decoding apparatus or a decoding method to be described later, but embodiments are not limited thereto.

The storage unit 1650 may store a reconstructed audio signal generated by the decoding module 1630. The storage unit 1650 may also store various programs required to operate the multimedia device 1600.

The speaker 1670 may output a reconstructed audio signal generated by the decoding module 1630 to the outside.

Figure 17:
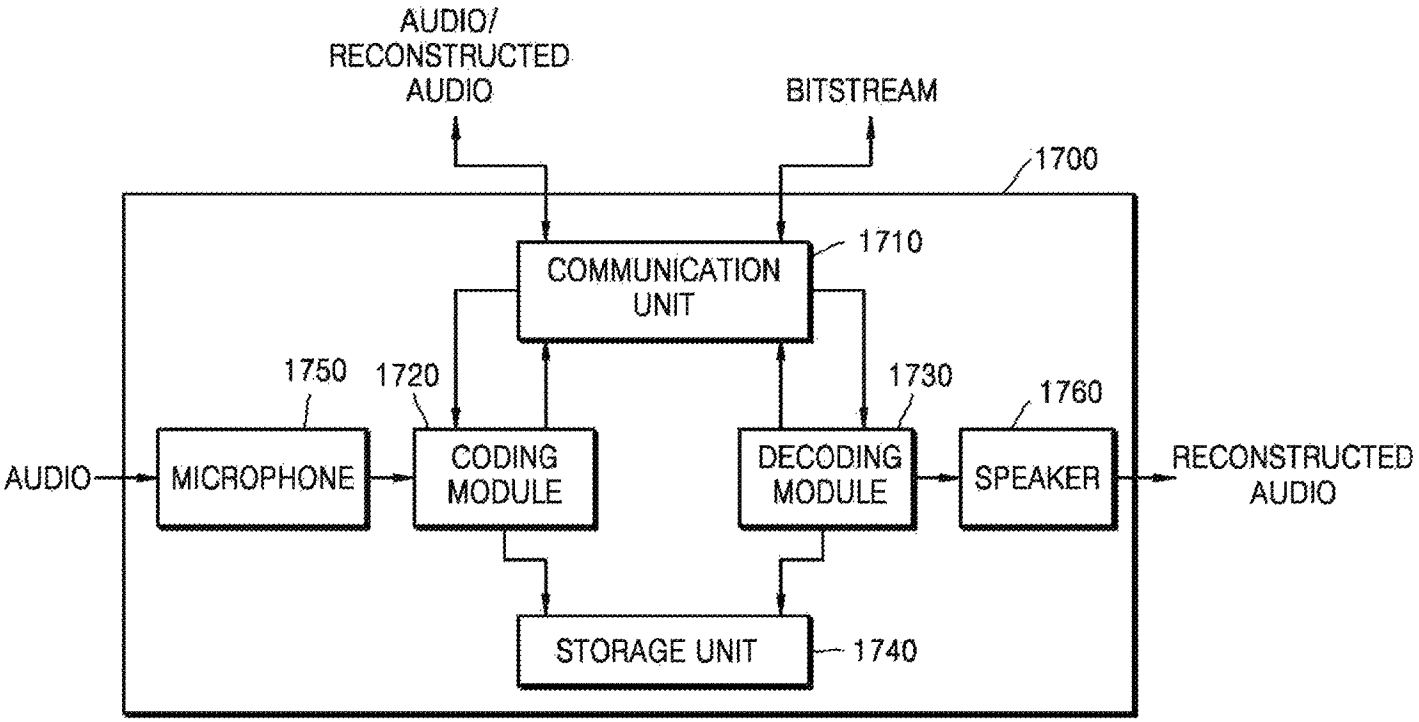
FIG. 17 is a block diagram of a multimedia apparatus including an encoding module and a decoding module, according to an exemplary embodiment.

FIG. 17 is a block diagram illustrating a configuration of a multimedia device including an encoding module and a decoding module, according to another exemplary embodiment.

A multimedia device 1700 shown in FIG. 17 may include a communication unit 1710, an encoding module 1720, and a decoding module 1730. In addition, a storage unit 1740 for storing an audio bitstream obtained as an encoding result or a reconstructed audio signal obtained as a decoding result may be further included according to the usage of the audio bitstream or the reconstructed audio signal. In addition, the multimedia device 1700 may further include a microphone 1750 or a speaker 1760. Herein, the encoding module 1720 and the decoding module 1730 may be integrated with other components (not shown) provided to the multimedia device 1700 and be implemented as at least one processor (not shown).

A detailed description of the same components as those in the multimedia device 1600 shown in FIG. 16 among components shown in FIG. 17 is omitted.

According to an embodiment, the encoding module 1720 may encode an audio signal in a time domain that is provided via the communication unit 1710 or the microphone 1750. The encoding may be performed using the above-described encoding apparatus, but embodiments are not limited thereto.

The microphone 1750 may provide an audio signal of a user or the outside to the encoding module 1720.

The multimedia devices 1600 and 1700 shown in FIGS. 16 and 17 may include a voice communication exclusive terminal including a telephone or a mobile phone, a broadcast or music exclusive device including a TV or an MP3 player, or a hybrid terminal device of the voice communication exclusive terminal and the broadcast or music exclusive device but is not limited thereto. In addition, the multimedia device 1600 or 1700 may be used as a transducer arranged in a client, in a server, or between the client and the server.

When the multimedia device 1600 or 1700 is, for example, a mobile phone, although not shown, a user input unit such as a keypad, a display unit for displaying a user interface or information processed by the mobile phone, and a processor for controlling a general function of the mobile phone may be further included. In addition, the mobile phone may further include a camera unit having an image pickup function and at least one component for performing functions required by the mobile phone.

When the multimedia device 1600 or 1700 is, for example, a TV, although not shown, a user input unit such as a keypad, a display unit for displaying received broadcast information, and a processor for controlling a general function of the TV may be further included. In addition, the TV may further include at least one component for performing functions required by the TV.

Figure 18:
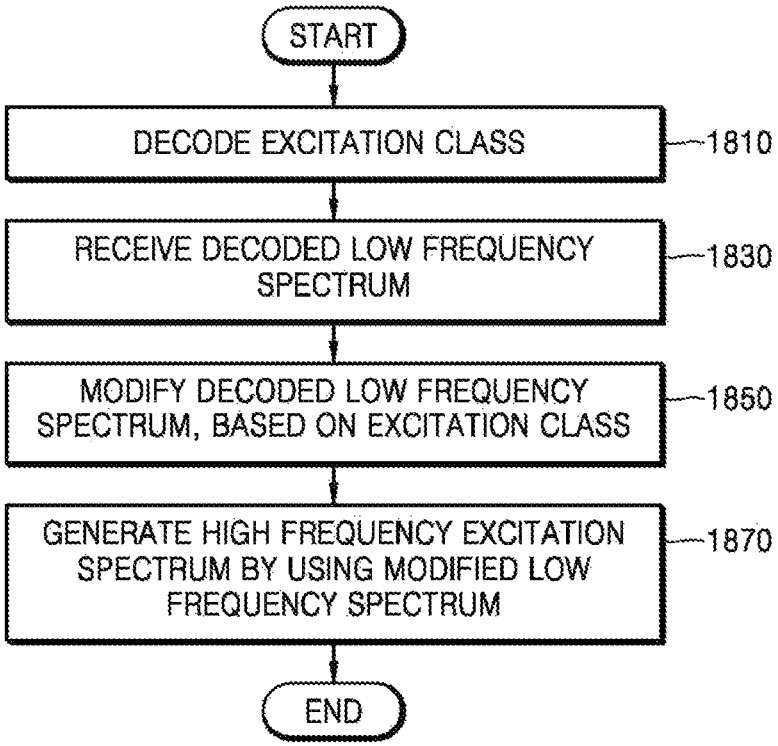
FIG. 18 is a flowchart of a high frequency decoding method according to an exemplary embodiment.

FIG. 18 is a flowchart of a high frequency decoding method according to an exemplary embodiment. The high frequency decoding method of FIG. 18 may be performed by the high frequency decoding unit 670 of FIG. 7 or may be performed by a special processor.

Referring to FIG. 18, in operation 1810, an excitation class is decoded. The excitation class may be generated by an encoder end and may be included in a bitstream and transmitted to a decoder end. Alternatively, the excitation class may be generated by the decoder end. The excitation class may be obtained in units of frames.

In operation 1830, a low frequency spectrum decoded from a quantization index of a low frequency spectrum included in the bitstream may be received. The quantization index may be, for example, a differential index between bands other than a lowest frequency band. The quantization index of the low frequency spectrum may be vector-dequantized. PVQ may be used for the vector-dequantization, but embodiments are not limited thereto. The decoded low frequency spectrum may be generated by performing noise filling with respect to a result of the dequantization. Noise filling is to fill a gap existing in a spectrum by being quantized to zero. A pseudo random noise may be inserted into the gap. A frequency bin section on which noise filling is performed may be preset. The amount of noise inserted into the gap may be controlled according to a parameter transmitted via the bitstream. A low frequency spectrum on which noise filling has been performed may be additionally denormalized. The low frequency spectrum on which noise filling has been performed may additionally undergo anti-sparseness processing. To achieve anti-sparseness processing, a coefficient having a random sign and a certain value of amplitude may be inserted into a coefficient portion remaining as zero within the low frequency spectrum on which noise filling has been performed. The energy of a low frequency spectrum on which anti-sparseness processing has been performed may be additionally controlled based on a dequantized envelope of a low band.

In operation 1850, the decoded low frequency spectrum may be modified based on the excitation class. The decoded low frequency spectrum may correspond to a dequantized spectrum, a noise filling-processed spectrum, or an anti-sparseness-processed spectrum. The amplitude of the decoded low frequency spectrum may be controlled according to the excitation class. For example, a decrement of the amplitude may depend on the excitation class.

In operation 1870, a high frequency excitation spectrum may be generated using the modified low frequency spectrum. The high frequency excitation spectrum may be generated by patching the modified low frequency spectrum to a high band required for BWE. An example of a patching method may be copying or folding a preset section to a high band.

Figure 19:
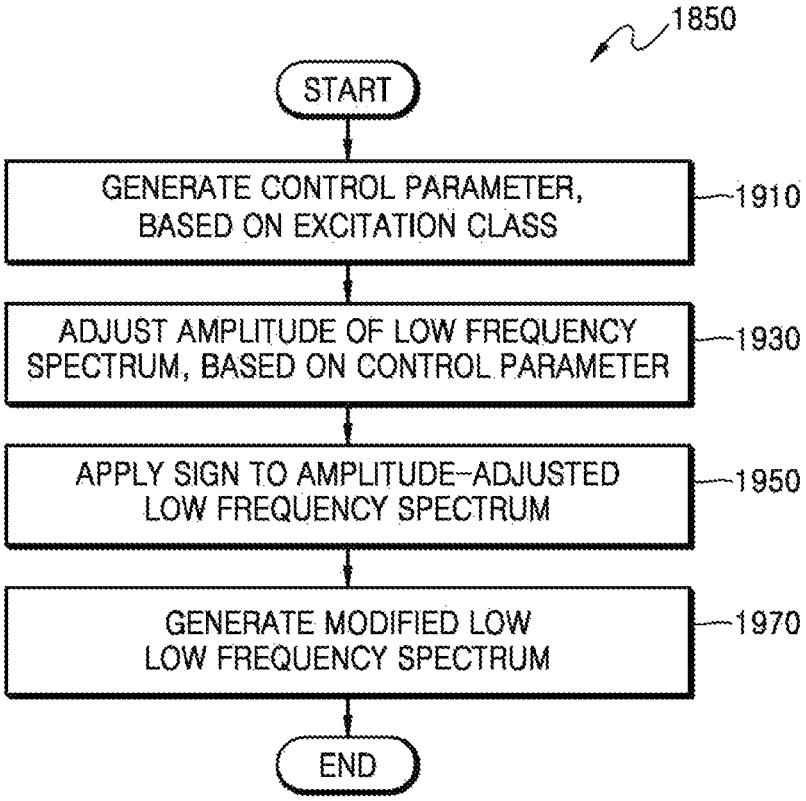
FIG. 19 is a flowchart of a low frequency spectrum modifying method according to an exemplary embodiment.

FIG. 19 is a flowchart of a low frequency spectrum modifying method according to an exemplary embodiment. The low frequency spectrum modifying method of FIG. 19 may correspond to operation 1850 of FIG. 18 or may be implemented independently. The low frequency spectrum modifying method of FIG. 19 may be performed by the low frequency spectrum modification unit 710 of FIG. 7 or may be performed by a special processor.

Referring to FIG. 19, in operation 1910, an amplitude control degree may be determined based on an excitation class. In detail, in operation 1910, a control parameter may be generated based on the excitation class in order to determine the amplitude control degree. According to an embodiment, the value of a control parameter may be determined according to whether the excitation class represents speech characteristics, tonal characteristics, or non-tonal characteristics.

In operation 1930, the amplitude of a low frequency spectrum may be controlled based on the determined amplitude control degree. When the excitation class represents speech characteristics or tonal characteristics, a control parameter having a larger value is generated than when the excitation class represents non-tonal characteristics. Thus, a decrement of the amplitude may increase. As an example of amplitude control, the amplitude may be reduced by a value obtained by multiplying a difference between the amplitude of each frequency bin, for example, a norm value of each frequency bin and an average norm value of a corresponding band, by a control parameter.

In operation 1950, a sign may be applied to an amplitude-controlled low frequency spectrum. According to the excitation class, the original sign or a random sign may be applied. For example, when the excitation class represents speech characteristics or tonal characteristics, the original sign may be applied. When the excitation class represents non-tonal characteristics, the random sign may be applied.

In operation 1970, a low frequency spectrum to which a sign has been applied in operation 1950 may be generated as the modified low frequency spectrum.

The methods according to the embodiments may be edited by computer-executable programs and implemented in a general-use digital computer for executing the programs by using a computer-readable recording medium. In addition, data structures, program commands, or data files usable in the embodiments of the present invention may be recorded in the computer-readable recording medium through various means. The computer-readable recording medium may include all types of storage devices for storing data readable by a computer system. Examples of the computer-readable recording medium include magnetic media such as hard discs, floppy discs, or magnetic tapes, optical media such as compact disc-read only memories (CD-ROMs), or digital versatile discs (DVDs), magneto-optical media such as floptical discs, and hardware devices that are specially configured to store and carry out program commands, such as ROMs, RAMs, or flash memories. In addition, the computer-readable recording medium may be a transmission medium for transmitting a signal for designating program commands, data structures, or the like. Examples of the program commands include a high-level language code that may be executed by a computer using an interpreter as well as a machine language code made by a compiler.

Although the embodiments of the present invention have been described with reference to the limited embodiments and drawings, the embodiments of the present invention are not limited to the embodiments described above, and their updates and modifications could be variously carried out by those of ordinary skill in the art from the disclosure. Therefore, the scope of the present invention is defined not by the above description but by the claims, and all their uniform or equivalent modifications would belong to the scope of the technical idea of the present invention.

The invention claimed is:

1. A decoding method for bandwidth extension (BWE), the method comprising:

decoding an excitation class for a current frame which is included in an audio bitstream;

generating a control parameter based on the excitation class to determine an amplitude control degree of a decoded low frequency audio spectrum;

controlling an amplitude of the decoded low frequency audio spectrum based on the generated control parameter; and generating a high frequency excitation audio spectrum based on the controlled amplitude of the decoded low frequency audio spectrum, wherein the excitation class indicates one among a plurality of classes including a speech excitation class and a non-speech excitation class.

2. The method of claim 1, wherein the controlling the amplitude of the decoded low frequency audio spectrum further comprises normalizing the decoded low frequency audio spectrum, and an amplitude of the normalized low frequency audio spectrum is controlled based on the generated control parameter.

3. The method of claim 1, wherein the controlling of the amplitude of the decoded low frequency audio spectrum is performed based on a difference between the amplitude of a spectral coefficient included in a specific band and an amplitude average of the specific band and based on the generated control parameter.

4. The method of claim 1, wherein the controlling the amplitude of the decoded low frequency audio spectrum further comprises applying a random sign or an original sign to an amplitude-controlled low frequency audio spectrum based on the excitation class.

5. The method of claim 1, wherein, when the excitation class is related to speech characteristics or tonal characteristics, an original sign is applied to an amplitude-controlled low frequency audio spectrum.

6. The method of claim 1, wherein, when the excitation class is related to non-tonal characteristics, a random sign is applied to the decoded low frequency audio spectrum.

7. The method of claim 1, wherein the decoded low frequency audio spectrum is a noise filling-processed audio spectrum or an anti-sparseness-processed audio spectrum.

8. A decoding apparatus for bandwidth extension (BWE), the apparatus comprising at least one processor configured to implement at least one decoder configured to: decode an excitation class for a current frame which is included in an audio bitstream, to generate a control parameter based on the excitation class in order to determine an amplitude control degree of a decoded low frequency audio spectrum, to control an amplitude of the decoded low frequency audio spectrum based on the generated control parameter, and to generate a high frequency excitation audio spectrum based on the controlled amplitude of the decoded low frequency audio spectrum, wherein the excitation class indicates one among a plurality of classes including a speech excitation class and a non-speech excitation class.

9. The apparatus of claim 8, wherein the at least one processor is further configured to implement:

a parameter decoding unit configured to decode the excitation class in the audio bitstream;

a low frequency audio spectrum modification unit configured to control the amplitude of the decoded low frequency audio spectrum based on the decoded excitation class to generate a modified decoded low frequency audio spectrum; and a high frequency excitation audio spectrum generation unit configured to generate the high frequency excitation audio spectrum based on the modified decoded low frequency audio spectrum.

10. The apparatus of claim 8, wherein, when the excitation class represents non-tonal characteristics, a dynamic range of the decoded low frequency audio spectrum is controlled more than when the excitation class represents speech characteristics or tonal characteristics.

* * * * *